US008836212B2

(12) United States Patent
Skipor et al.

(10) Patent No.: US 8,836,212 B2
(45) Date of Patent: Sep. 16, 2014

(54) LIGHT EMISSIVE PRINTED ARTICLE PRINTED WITH QUANTUM DOT INK

(75) Inventors: Andrew F. Skipor, West Chicago, IL (US); Krishna D. Jonnalagadda, Algonquin, IL (US); Krishna Kalyanasundaram, Elmhurst, IL (US)

(73) Assignee: QD Vision, Inc., Lexington, MA (US)

( * ) Notice: Subject to any disclaimer, the term of this patent is extended or adjusted under 35 U.S.C. 154(b) by 910 days.

(21) Appl. No.: 11/622,215

(22) Filed: Jan. 11, 2007

(65) Prior Publication Data

US 2008/0169753 A1 Jul. 17, 2008

(51) Int. Cl.
*H01J 1/62* (2006.01)
*B41M 3/00* (2006.01)

(52) U.S. Cl.
CPC ..... *B41M 3/006* (2013.01)
USPC ..... 313/504; 313/501; 313/502; 313/503

(58) Field of Classification Search
CPC ..... B41M 3/006
USPC ..... 313/483–512; 359/665, 666; 977/950
See application file for complete search history.

(56) References Cited

U.S. PATENT DOCUMENTS

| | | | |
|---|---|---|---|
| 3,510,732 | A | 5/1970 | Amans et al. |
| 3,774,086 | A | 11/1973 | Vincent, Jr. |
| 3,825,792 | A | 7/1974 | Rokosz et al. |
| 3,875,456 | A | 4/1975 | Kano et al. |
| 4,035,686 | A | 7/1977 | Fleming |
| 4,082,889 | A | 4/1978 | DiStefano |
| 4,130,343 | A | 12/1978 | Miller et al. |
| 4,366,407 | A | 12/1982 | Walsh |
| 4,377,750 | A | 3/1983 | Pape et al. |
| 4,382,272 | A | 5/1983 | Quella et al. |
| 4,394,068 | A | 7/1983 | Pape et al. |
| 4,608,301 | A | 8/1986 | Ishizuka et al. |
| 4,652,464 | A | 3/1987 | Ludlum et al. |
| 4,719,386 | A | 1/1988 | Toho |
| 4,738,798 | A | 4/1988 | Mahler |
| 4,766,526 | A | 8/1988 | Morimoto et al. |
| 4,772,885 | A | 9/1988 | Uehara et al. |
| 4,780,752 | A | 10/1988 | Angerstein et al. |
| 4,820,016 | A | 4/1989 | Cohen et al. |
| 4,929,053 | A | 5/1990 | Miller-Stute et al. |
| 4,931,692 | A | 6/1990 | Tagaki et al. |
| 5,064,718 | A | 11/1991 | Buscall et al. |

(Continued)

FOREIGN PATENT DOCUMENTS

| | | |
|---|---|---|
| EP | 0328202 | 8/1989 |
| EP | 1731583 | 12/2006 |

(Continued)

OTHER PUBLICATIONS

S. Coe-Sullivan, J.S. Steckel, WK Woo, M. G. Bawendi, and V. Bulovic, "Large Area Ordered Quantum Dot Monolayer's via Phase Separation During Spin-Casting," Adv. Func. Materials, 2005, 15, 1117-1124.

(Continued)

*Primary Examiner* — Elmito Breval

(57) ABSTRACT

A light emissive printed articles (101) include printing with ink that includes quantum dots in lieu of pigment. A pump light that emits light with photon energies sufficient to excite the quantum dot ink (102) is used to drive light emission.

15 Claims, 5 Drawing Sheets

(56) References Cited

U.S. PATENT DOCUMENTS 5,077,147 A 12/1991 Tanaka et al.
5,091,115 A 2/1992 Nogami et al.
5,093,286 A 3/1992 Nogami et al.
5,132,051 A 7/1992 Herron
5,208,462 A 5/1993 O'Connor et al.
5,243,457 A 9/1993 Spencer
5,260,957 A 11/1993 Hakimi et al.
5,294,870 A 3/1994 Tang et al.
5,300,783 A 4/1994 Spencer et al.
5,422,489 A 6/1995 Bhargava
5,434,878 A 7/1995 Lawandy
5,442,254 A 8/1995 Jaskie
5,455,489 A 10/1995 Bhargava
5,470,910 A 11/1995 Spanhel et al.
5,504,661 A 4/1996 Szpak
5,527,386 A 6/1996 Statz
5,534,056 A 7/1996 Kuehule et al.
5,586,879 A 12/1996 Szpak
5,599,897 A 2/1997 Nishiguchi et al.
5,716,679 A 2/1998 Krug et al.
5,717,289 A 2/1998 Tanaka
5,777,433 A 7/1998 Lester et al.
5,813,752 A 9/1998 Singer et al.
5,813,753 A 9/1998 Vriens et al.
5,830,529 A * 11/1998 Ross ..... 427/152
5,847,507 A 12/1998 Butterworth et al.
5,874,803 A 2/1999 Garbuzov et al.
5,881,200 A 3/1999 Burt
5,882,779 A 3/1999 Lawandy
5,909,081 A 6/1999 Eida et al.
5,917,279 A 6/1999 Elschner et al.
5,955,528 A 9/1999 Sato et al.
5,955,837 A 9/1999 Horikx et al.
5,959,316 A 9/1999 Lowery et al.
5,962,971 A 10/1999 Chen
5,982,092 A 11/1999 Chen
5,988,822 A 11/1999 Abe et al.
5,998,925 A 12/1999 Shimizu et al.
6,023,371 A 2/2000 Onitsuka et al.
6,048,616 A 4/2000 Gallagher et al.
6,066,861 A 5/2000 Hohn et al.
6,117,529 A 9/2000 Leising et al.
6,166,856 A 12/2000 Araki et al.
6,236,493 B1 5/2001 Schmidt et al.
6,249,372 B1 6/2001 Kobayashi et al.
6,259,506 B1 7/2001 Lawandy
6,319,426 B1 * 11/2001 Bawendi et al. ..... 252/301.4 R
6,322,901 B1 11/2001 Bawendi et al.
6,340,824 B1 1/2002 Komoto et al.
6,358,652 B1 3/2002 Tomiuchi et al.
6,422,712 B1 7/2002 Nousiainen et al.
6,464,898 B1 10/2002 Tomoike et al.
6,473,554 B1 10/2002 Pelka et al.
6,482,664 B1 11/2002 Kanekiyo
6,493,051 B2 12/2002 Ha et al.
6,501,091 B1 12/2002 Bawendi et al.
6,515,314 B1 2/2003 Duggal et al.
6,565,770 B1 5/2003 Mayer et al.
6,576,155 B1 * 6/2003 Barbera-Guillem ..... 252/301.36
6,576,291 B2 6/2003 Bawendi et al.
6,577,073 B2 6/2003 Shimizu et al.
6,580,545 B2 6/2003 Morrison et al.
6,586,096 B2 7/2003 Border et al.
6,600,175 B1 7/2003 Baretz et al.
6,608,332 B2 8/2003 Shimizu et al.
6,608,439 B1 8/2003 Sokolik et al.
6,613,247 B1 9/2003 Hohn et al.
6,637,924 B2 10/2003 Pelka et al.
6,639,733 B2 10/2003 Minano et al.
6,641,755 B2 11/2003 Tomoike et al.
6,642,652 B2 11/2003 Collins, III et al.
6,650,044 B1 11/2003 Lowery
6,653,778 B1 11/2003 Tomiuchi et al.
6,656,566 B1 12/2003 Kuykendall et al.
6,677,610 B2 1/2004 Choi et al.
6,692,031 B2 2/2004 McGrew
6,703,781 B2 3/2004 Zovko
6,710,366 B1 3/2004 Lee et al.
6,710,911 B2 3/2004 LoCascio et al.
6,731,359 B1 5/2004 Fukaya
6,734,465 B1 5/2004 Taskar et al.
6,744,077 B2 6/2004 Trottier et al.
6,744,960 B2 6/2004 Pelka
6,777,531 B2 8/2004 Yasuda et al.
6,777,706 B1 8/2004 Tessler et al.
6,781,148 B2 8/2004 Kubota et al.
6,784,603 B2 8/2004 Pelka et al.
6,791,259 B1 9/2004 Stokes et al.
6,793,755 B2 * 9/2004 Schaupp et al. ..... 156/215
6,794,686 B2 9/2004 Chang et al.
6,803,719 B1 10/2004 Miller et al.
6,812,500 B2 11/2004 Reeh et al.
6,819,845 B2 11/2004 Lee et al.
6,821,559 B2 11/2004 Eberspacher et al.
6,827,769 B2 12/2004 Auslander et al.
6,830,835 B2 12/2004 Saito et al.
6,835,326 B2 12/2004 Barbera-Guillem
6,838,743 B2 1/2005 Yamada et al.
6,841,785 B2 1/2005 Nolt
6,849,109 B2 2/2005 Yadav et al.
6,858,470 B1 2/2005 Han et al.
6,864,626 B1 3/2005 Weiss et al.
6,870,311 B2 3/2005 Mueller et al.
6,876,796 B2 4/2005 Garito et al.
6,885,033 B2 4/2005 Andrews
6,887,332 B1 5/2005 Kagan et al.
6,891,330 B2 5/2005 Duggal et al.
6,903,505 B2 6/2005 McNulty et al.
6,913,830 B2 7/2005 Decker et al.
6,914,106 B2 7/2005 Leon et al.
6,924,596 B2 8/2005 Sato et al.
6,957,608 B1 10/2005 Hubert et al.
6,984,297 B2 1/2006 Nisch et al.
7,005,667 B2 2/2006 Chen et al.
7,005,669 B1 2/2006 Lee
7,008,559 B2 3/2006 Chen
7,040,774 B2 5/2006 Beeson et al.
7,042,020 B2 5/2006 Negley
7,045,956 B2 5/2006 Braune et al.
7,046,439 B2 5/2006 Kaminsky et al.
7,065,285 B2 6/2006 Chen et al.
7,066,623 B2 6/2006 Lee et al.
7,070,300 B2 7/2006 Harbers et al.
7,078,732 B1 7/2006 Reeh et al.
7,090,355 B2 8/2006 Liu et al.
7,091,653 B2 8/2006 Ouderkirk et al.
7,091,656 B2 8/2006 Murazaki et al.
7,102,152 B2 9/2006 Chua et al.
7,123,796 B2 10/2006 Steckl et al.
7,126,162 B2 10/2006 Reeh et al.
7,129,515 B2 10/2006 Okuyama et al.
7,135,816 B2 11/2006 Kawaguchi et al.
7,144,131 B2 12/2006 Rains
7,160,613 B2 1/2007 Bawendi et al.
7,166,010 B2 1/2007 Lamansky et al.
7,168,833 B2 1/2007 Schottland et al.
7,172,811 B2 2/2007 Denisyuk et al.
7,175,948 B2 2/2007 Yoshihara et al.
7,189,768 B2 3/2007 Baran et al.
7,190,870 B2 3/2007 Sundar et al.
7,196,354 B1 3/2007 Erchak et al.
7,199,393 B2 4/2007 Park et al.
7,213,940 B1 5/2007 Van De Ven et al.
7,214,428 B2 5/2007 Naasani
7,235,792 B2 6/2007 Elofson
7,239,080 B2 7/2007 Ng et al.
7,242,030 B2 7/2007 Wang et al.
7,253,452 B2 8/2007 Steckel et al.
7,265,488 B2 9/2007 Ng et al.
7,273,309 B2 9/2007 Ford et al.
7,294,861 B2 11/2007 Schardt et al.
7,321,193 B2 1/2008 Antoniadis et al.
7,326,365 B2 2/2008 Bawendi et al.
7,350,933 B2 4/2008 Ng et al.

(56) References Cited

U.S. PATENT DOCUMENTS 7,374,807 B2 5/2008 Parce et al.
7,390,568 B2 6/2008 Kim et al.
7,393,618 B2 7/2008 Ioku et al.
7,420,323 B2 9/2008 Krummacher
7,430,355 B2 9/2008 Heikenfeld et al.
7,462,502 B2 12/2008 Paolini et al.
7,481,562 B2 1/2009 Chua et al.
7,495,383 B2 2/2009 Chua et al.
7,497,581 B2 3/2009 Beeson et al.
7,513,669 B2 4/2009 Chua et al.
7,534,002 B2 5/2009 Yamaguchi et al.
7,535,524 B2 5/2009 Chua et al.
7,553,683 B2 6/2009 Martin et al.
7,554,257 B2 6/2009 Krummacher et al.
7,560,747 B2 7/2009 Cok
7,560,859 B2 7/2009 Saito et al.
7,614,759 B2 11/2009 Negley
7,645,397 B2 1/2010 Parce et al.
7,682,850 B2 3/2010 Harbers et al.
7,686,493 B2 3/2010 Roshan et al.
7,692,373 B2 4/2010 Bawendi et al.
7,695,150 B2 4/2010 Dejima et al.
7,723,744 B2 5/2010 Gillies
7,901,111 B2 3/2011 Negley
7,902,748 B2 3/2011 Cok
7,952,105 B2 5/2011 Cok
7,989,153 B2 8/2011 Skipor et al.
8,128,249 B2 3/2012 Skipor et al.
8,405,063 B2 3/2013 Kazlas et al.
2001/0001207 A1 5/2001 Shimizu et al.
2002/0071948 A1 6/2002 Duff et al.
2002/0157574 A1 10/2002 Weitzel et al.
2002/0186921 A1 12/2002 Schumacher et al.
2003/0010987 A1 1/2003 Banin et al.
2003/0044114 A1 3/2003 Pelka
2003/0048346 A1 3/2003 Chow
2003/0107688 A1 6/2003 Yamagishi
2003/0151700 A1 8/2003 Carter et al.
2003/0156425 A1 8/2003 Turnbull et al.
2003/0160260 A1 8/2003 Hirai et al.
2003/0211288 A1 11/2003 Schottland
2003/0227249 A1 12/2003 Mueller et al.
2004/0007169 A1 1/2004 Ohtsu et al.
2004/0067431 A1 4/2004 Arney et al.
2004/0095658 A1 5/2004 Buretea et al.
2004/0118448 A1 6/2004 Scher et al.
2004/0131789 A1 7/2004 Brown
2004/0178338 A1 9/2004 Empedocles et al.
2004/0201664 A1 10/2004 Bringley et al.
2004/0203170 A1 10/2004 Barbera-Guillem
2004/0233139 A1 11/2004 Asano et al.
2004/0245912 A1 12/2004 Thurk et al.
2004/0262583 A1 12/2004 Lee
2005/0012076 A1 1/2005 Morioka
2005/0088079 A1 4/2005 Daniels
2005/0093422 A1 5/2005 Wang et al.
2005/0098787 A1 5/2005 Andrews
2005/0133087 A1 6/2005 Alivisatos et al.
2005/0134723 A1 6/2005 Lee et al.
2005/0135079 A1 6/2005 Yin Chua et al.
2005/0139852 A1 6/2005 Chen et al.
2005/0142343 A1 6/2005 Winkler et al.
2005/0164227 A1 7/2005 Ogura et al.
2005/0180680 A1 8/2005 Kong
2005/0185686 A1 8/2005 Rupasov et al.
2005/0214967 A1 9/2005 Scher et al.
2005/0230693 A1 10/2005 Chen
2005/0236556 A1 10/2005 Sargent et al.
2005/0261400 A1 11/2005 Yang et al.
2005/0265404 A1 12/2005 Ashdown
2005/0275615 A1 12/2005 Kahen et al.
2005/0279949 A1 12/2005 Oldham et al.
2006/0001036 A1 1/2006 Jacob et al.
2006/0002101 A1 1/2006 Wheatley
2006/0003097 A1 1/2006 Andres et al.
2006/0003114 A1 1/2006 Enlow et al.
2006/0003156 A1 1/2006 Masutani et al.
2006/0012853 A1 1/2006 Tallone et al.
2006/0024525 A1 2/2006 Jeong et al.
2006/0034065 A1 2/2006 Thurk
2006/0038182 A1 2/2006 Rogers et al.
2006/0040103 A1 2/2006 Whiteford et al.
2006/0060862 A1 3/2006 Bawendi et al.
2006/0063289 A1 3/2006 Negley et al.
2006/0066210 A1 3/2006 Ng et al.
2006/0068154 A1 3/2006 Parce et al.
2006/0071218 A1 4/2006 Takeda et al.
2006/0081862 A1 4/2006 Chua et al.
2006/0103589 A1 5/2006 Chua et al.
2006/0105483 A1 5/2006 Leatherdale et al.
2006/0113895 A1 6/2006 Baroky et al.
2006/0128845 A1 6/2006 Emrick et al.
2006/0145599 A1 7/2006 Stegamat et al.
2006/0147703 A1 7/2006 Walker et al.
2006/0157686 A1 7/2006 Jang et al.
2006/0157720 A1 7/2006 Bawendi et al.
2006/0169971 A1 8/2006 Cho et al.
2006/0196375 A1 9/2006 Coe-Sullivan et al.
2006/0197437 A1 9/2006 Krummacher et al.
2006/0199886 A1 9/2006 Ryang
2006/0204676 A1 9/2006 Jones et al.
2006/0204679 A1 9/2006 Jones et al.
2006/0210726 A1 9/2006 Jones et al.
2006/0214903 A1 9/2006 Kurosaka
2006/0215958 A1 9/2006 Yeo et al.
2006/0216508 A1 9/2006 Denisyuk et al.
2006/0216759 A1 9/2006 Naasani
2006/0221021 A1 10/2006 Hajjar et al.
2006/0227546 A1 10/2006 Yeo et al.
2006/0238103 A1 10/2006 Choi et al.
2006/0238671 A1 10/2006 Kim et al.
2006/0240258 A1 10/2006 Sato et al.
2006/0244367 A1 11/2006 Im et al.
2006/0245710 A1 11/2006 Borrelli et al.
2006/0268571 A1 11/2006 Harada et al.
2006/0274226 A1 12/2006 Im et al.
2006/0279296 A1 12/2006 Lee et al.
2006/0286382 A1 12/2006 Anzures et al.
2006/0291252 A1 12/2006 Lim et al.
2007/0012928 A1 1/2007 Peng et al.
2007/0012941 A1 1/2007 Cheon
2007/0014318 A1 1/2007 Hajjar et al.
2007/0018102 A1 1/2007 Braune et al.
2007/0034833 A1 2/2007 Parce et al.
2007/0036510 A1 2/2007 Ingman et al.
2007/0036962 A1 2/2007 Sasaki et al.
2007/0045777 A1 3/2007 Gillies et al.
2007/0085092 A1 4/2007 Chen
2007/0087197 A1 4/2007 Jang et al.
2007/0090755 A1 4/2007 Eida et al.
2007/0096078 A1 5/2007 Lee et al.
2007/0096634 A1 5/2007 Krummacher
2007/0098160 A1 5/2007 Lablans
2007/0112097 A1 5/2007 Olson et al.
2007/0112101 A1 5/2007 Choi et al.
2007/0112118 A1 5/2007 Park et al.
2007/0115995 A1 5/2007 Kim et al.
2007/0121129 A1 5/2007 Eida et al.
2007/0131905 A1 6/2007 Sato et al.
2007/0145350 A1 6/2007 Kobori
2007/0152177 A1 7/2007 Nichols
2007/0164661 A1 7/2007 Kuma
2007/0170447 A1 7/2007 Negley et al.
2007/0200492 A1 8/2007 Cok et al.
2007/0201056 A1 8/2007 Cok et al.
2007/0223219 A1 9/2007 Medendorp et al.
2007/0241661 A1 10/2007 Yin
2007/0263408 A1 11/2007 Chua et al.
2007/0281140 A1 12/2007 Haubrich et al.
2007/0298160 A1 12/2007 Jang et al.
2008/0001124 A1 1/2008 Hachiya et al.
2008/0001167 A1 1/2008 Coe-Sullivan et al.
2008/0001528 A1 1/2008 Eida
2008/0012031 A1 1/2008 Jang et al.

(56) References Cited

U.S. PATENT DOCUMENTS

| | | | |
|---|---|---|---|
| 2008/0029710 | A1 | 2/2008 | Sekiya et al. |
| 2008/0037282 | A1 | 2/2008 | Kurihara et al. |
| 2008/0048936 | A1 | 2/2008 | Powell et al. |
| 2008/0057342 | A1 | 3/2008 | Sekiya |
| 2008/0070153 | A1 | 3/2008 | Ioku et al. |
| 2008/0074050 | A1 | 3/2008 | Chen et al. |
| 2008/0165235 | A1 | 7/2008 | Rolly et al. |
| 2008/0169753 | A1 | 7/2008 | Skipor et al. |
| 2008/0172197 | A1 | 7/2008 | Skipor et al. |
| 2008/0173886 | A1 | 7/2008 | Cheon et al. |
| 2008/0237540 | A1 | 10/2008 | Dubrow |
| 2008/0254210 | A1 | 10/2008 | Lai et al. |
| 2008/0276817 | A1 | 11/2008 | Hinch et al. |
| 2008/0277626 | A1 | 11/2008 | Yang et al. |
| 2008/0308825 | A1 | 12/2008 | Chakraborty et al. |
| 2009/0001385 | A1 | 1/2009 | Skipor et al. |
| 2009/0017268 | A1 | 1/2009 | Skipor et al. |
| 2009/0021148 | A1 | 1/2009 | Hachiya et al. |
| 2009/0034292 | A1 | 2/2009 | Pokrovskiy et al. |
| 2009/0050907 | A1 | 2/2009 | Yuan et al. |
| 2009/0057662 | A1 | 3/2009 | Brazis et al. |
| 2009/0059554 | A1 | 3/2009 | Skipor et al. |
| 2009/0114932 | A1 | 5/2009 | Chou |
| 2009/0152567 | A1 | 6/2009 | Comerford et al. |
| 2009/0162011 | A1 | 6/2009 | Coe-Sullivan et al. |
| 2009/0174022 | A1 | 7/2009 | Coe-Sullivan et al. |
| 2009/0196160 | A1 | 8/2009 | Crombach et al. |
| 2009/0208753 | A1 | 8/2009 | Coe-Sullivan et al. |
| 2009/0212695 | A1 | 8/2009 | Kim et al. |
| 2009/0215208 | A1 | 8/2009 | Coe-Sullivan et al. |
| 2009/0215209 | A1 | 8/2009 | Anc et al. |
| 2009/0236621 | A1 | 9/2009 | Chakraborty |
| 2009/0251759 | A1 | 10/2009 | Domash et al. |
| 2009/0283743 | A1 | 11/2009 | Coe-Sullivan et al. |
| 2009/0321755 | A1 | 12/2009 | Jang et al. |
| 2010/0002414 | A1 | 1/2010 | Meir et al. |
| 2010/0051898 | A1 | 3/2010 | Kim et al. |
| 2010/0068468 | A1 | 3/2010 | Coe-Sullivan et al. |
| 2010/0103648 | A1 | 4/2010 | Kim et al. |
| 2010/0110728 | A1 | 5/2010 | Dubrow et al. |
| 2010/0113813 | A1 | 5/2010 | Pickett et al. |
| 2010/0123155 | A1 | 5/2010 | Pickett et al. |
| 2010/0144231 | A1 | 6/2010 | Landry et al. |
| 2010/0155749 | A1 | 6/2010 | Chen et al. |
| 2010/0167011 | A1 | 7/2010 | Dubrow |
| 2010/0193806 | A1 | 8/2010 | Byun |
| 2010/0208493 | A1 | 8/2010 | Choi et al. |
| 2010/0243053 | A1 | 9/2010 | Coe-Sullivan et al. |
| 2010/0246009 | A1 | 9/2010 | Polley et al. |
| 2010/0265307 | A1 | 10/2010 | Linton et al. |
| 2010/0283036 | A1 | 11/2010 | Coe-Sullivan et al. |
| 2010/0283072 | A1 | 11/2010 | Kazlas et al. |
| 2010/0314646 | A1 | 12/2010 | Breen et al. |
| 2011/0103064 | A1 | 5/2011 | Coe-Sullivan et al. |
| 2011/0186811 | A1 | 8/2011 | Coe-Sullivan et al. |
| 2011/0199555 | A1 | 8/2011 | Coe-Sullivan et al. |
| 2011/0233483 | A1 | 9/2011 | Breen et al. |
| 2012/0113672 | A1 | 5/2012 | Dubrow et al. |

FOREIGN PATENT DOCUMENTS

| | | | |
|---|---|---|---|
| EP | 1793330 | | 6/2007 |
| EP | 1912233 | | 4/2008 |
| GB | 2147542 | A | 5/1985 |
| JP | 02-244104 | | 9/1990 |
| JP | 04-229807 | | 8/1992 |
| JP | 4238304 | | 8/1992 |
| JP | 04-281433 | | 10/1992 |
| JP | 05-152609 | | 6/1993 |
| JP | 05-303017 | | 11/1993 |
| JP | 06-163984 | | 6/1994 |
| JP | 06-238161 | | 8/1994 |
| JP | 06-301071 | | 10/1994 |
| JP | 07-002912 | | 1/1995 |
| JP | 08-007614 | | 1/1996 |
| JP | 08-007614 | | 12/1996 |
| JP | 09-027642 | | 1/1997 |
| JP | 09-050057 | | 2/1997 |
| JP | 09-080434 | | 3/1997 |
| JP | 11-224556 JP | | 8/1999 |
| JP | 2002091352 | | 3/2002 |
| JP | 2002-216962 | | 8/2002 |
| JP | 2004-071357 | | 3/2004 |
| JP | 2005038768 | | 2/2005 |
| JP | 2006-073869 | | 3/2006 |
| JP | 2006059723 | | 3/2006 |
| JP | 2006073202 | | 3/2006 |
| JP | 2007103513 | | 4/2007 |
| WO | WO-98/30998 | | 7/1998 |
| WO | WO 03/025539 | | 3/2003 |
| WO | WO-03/070816 | | 8/2003 |
| WO | WO-03/079414 | | 9/2003 |
| WO | WO-2005/067524 | | 7/2005 |
| WO | WO-2006055873 | | 5/2006 |
| WO | WO2006055873 | A2 | 5/2006 |
| WO | WO-2006/104689 | | 10/2006 |
| WO | WO-2007/002234 | | 1/2007 |
| WO | WO-2007/009010 | | 1/2007 |
| WO | WO-2007/046649 | | 4/2007 |
| WO | WO-2007-103310 | A3 | 11/2007 |
| WO | WO-2007/136816 | | 11/2007 |
| WO | WO-2008/088663 | | 7/2008 |
| WO | WO-2009/002512 | | 12/2008 |
| WO | WO-2009/011922 | | 1/2009 |
| WO | WO-2009/014590 | | 1/2009 |
| WO | WO-2009/014707 | | 1/2009 |
| WO | WO-2009/035657 | | 3/2009 |
| WO | WO-2009/137053 | | 11/2009 |
| WO | WO-2009/145813 | | 12/2009 |
| WO | WO-2009/151515 | | 12/2009 |
| WO | WO-2010/014205 | | 2/2010 |
| WO | WO2010/129350 | | 11/2010 |
| WO | WO2010/129374 | | 11/2010 |
| WO | WO2011/020098 | | 2/2011 |
| WO | WO 2012/021643 | | 2/2012 |

OTHER PUBLICATIONS

S. Coe-Sullivan, WK Woo, M. G. Bawendi, and V. Bulovic, "Electroluminescence from single monolayers of nanocrystals in molecular organic devices," Letters to Nature, Nature vol. 420, Dec. 19-26, 2002, Nature Publishing Group , 2002, pp. 800-803.

G. Moeller and S. Coe-Sullivan, "Quantum-Dot Light Emitting Devices for Displays," Information Display Conference, 2006.

A. Akimov, et al, "Semiconductor nanocrystals in a polymeric matrix: new optical media" Opt. Spectrosc. 72 (4), Apr. 1992.

Dabbousi, et al., J. Phys. Chem 101 : 9463 (1997).

D.E. Fogg, et al, "Fabrication of Quantum Dot-Polymer Composites-:Semiconductor Nanoclusters in Dual-Function Polymer Matrices with Electron-Transporting and Cluster-Passivating Properties" Macromolecules 1997, 30, 417-426.

N.C. Greenham, et al, "Charge seperation and transport in conjugated-polymer/semiconductor-nanocrystal composites studied by photoluminescense quenching and photoconductivity" Physical Review B vol. 54, No. 24, Dec. 15, 1996, pp. I7628-17637.

Margaret A. Hines, et al, "Synthesis and Characterization of strongly Luminescing ZnS-Capped CdSe Nanocrystals" J.Phys. Chem. 1996, 100, 468-471.

C.R. Kagan, et al, "Long-range resonance transfer of electronic excitations in close-packed CdSe Quantum-dot solids" Physical Review B vol. 54, No. 12 Sep. 15, 1996-II.

S.A. Empedocles, et al, "Photoluminescence Spectrosopy of Single CdSe nanocrystallite Quantum Dots" vol. 77, No. 18, Oct. 28, 1996.

F.V. Mikulec, et al, "Synthesis and Characterization of Highly Luminescent (CdSe)ZnS Quantum Dots" Met. Res. Soc. Symp. Proc. vol. 452 1997 Materials Research Society.

A.R. Kortan, et al, "Nucleation and Growth of CdSe on ZnS Quantum Crystallite Seeds, and Vice Versa in Inverse Micelle Media" Journal of the American Chemical Society, 1990, 112, 1327-1332.

(56) References Cited

OTHER PUBLICATIONS

Horst Weller, "Quantized Semiconductor Particles: A Novel State of Matter for Materials Science" Adv. Mater. 1993. 5. No. 2, pp. 88-95.
Jinwook Lee, et al, "Full Color Emission from II-VI Semiconductor Quantum Dot-Polymer Composites" Adv. Mater. 2000, 12, No. 15, Aug. 2, 1102-1105.
C.B. Murray, et al, "Synthesis and Characterization of Nearly Monodisperse CdE (E=S, Se, Te) Semiconductor Nanocrystallites" 1993 American Chemical Society, 115, 8706-8715.
A.V. Firth, et al., "Optical Properties of CdSe nanocrystals in a polymer matrix", Applied Physics Letters, vol. 75, No. 20, 3120 et seq. (1999).
S. Yanagida, et al., "Preparation of Quantized-CdS Doped Poly(Methyl Methacrylate) Films, Optical and Morphotogical Properties", Chem. Lett., pp. 1773-1776, 1990.
Pelling and Sauter 2004 colour at nanoscale.
International Search Report on Patentability, issued Jan. 5, 2010, for PCT/US2008/07902.
International Report on Patentability,issued Sep. 9, 2008, for PCT/US2007/005589.
Supplemental EP Search Report for EP 07752303.3-1218/2041478 PCT/US2007/005589.
International Report on Patentability, issued Jul. 14, 2009, for PCT/US2007/088921.
U.S. Appl. No. 12/231,887 Office Action dated Dec. 28, 2009.
U.S. Appl. No. 12/231,887 Office Action dated Nov. 24, 2010.
B.O. Dabbousi, et al., "Electroluminescence from CdSe quantum-dot/polymer composites" Appl. Phys. Lett. 66(11), Mar. 13, 1995.
Fuchs, D.T., et al., "Making waveguides containing nanocrystalline quantum dots", Proc. Of SPIE, vol. 5592 (SPIE Bellingham, WA 2005).
Lim, J; et al., "Preparation of Highly Luminescent Nanocrystals and Their Application to Light-Emitting Diodes", Adv. Mater., 2007, 19, 1927-1932.
Olsson, Y.K., et al., "Fabrication and optical properties of polymeric waveguides containing nanocrystalline quantum dots", Appl., Phys. Lett., vol. 85, No. 19, Nov. 8, 2004, pp. 4469-4471.
Shea Rohwer, L.E.; et al., "Development of solid state light sources based on II-VI semiconductor quantum dots", Proc. Of SPIE vol. 5366, pp. 66 74.
Song, H.; et al., "Photoluminescent (CdSe)ZnS quantum dot-polymethylmethacrylate polymer composite thin films in the visible range", Nanotechnology 18 (2007) 055401 (6 pp).
Woelfle, C., et al., "Transparent and flexible quantum-dot polymer composites using an ionic liquid as compatible polymerization medium", Nanotechnology 18 (2007) 025402 (9 pp).
Yamasaki, T., et al., "Organic light-emitting device with an ordered monolayer of silica microspheres as a scattering medium", Appl. Phys. Lett. vol. 76, No. 10, Mar. 6, 2000, p. 1243 et seq.
Chason, M., et al."Free-Standing Quantum Dots for Electronic Applications", Proceedings of SPIE—Quantum Sensing and Nanophotonic Devices IV 2007, SPIE, US, vol. 6479, Feb. 2, 2007, pp. 64790E-1-64790E-08. XP-002500571.
European Patent Office Communication, dated Jul. 12, 2012, in European Patent Application No. 07 752 303.3. which is the EP counterpart of U.S. Appl. No. 12/231,887.
U.S. Appl. No. 12/231,887 Office Action dated Mar. 22, 2013.
U.S. Appl. No. 12/657,282 Office Action dated Jan. 23, 2013.
JP Office Action mailed May 8, 2012 (and English Translation) in Japanese Application No. 2010-514795 filed Dec. 24, 2009 (JP counterpart of U.S. Appl. No. 12/283,609 filed Sep. 12, 2008).
JP Office Action mailed Dec. 25, 2012 (and English Translation) in Japanese Application No. 2010-0517028 filed Jan. 15, 2010 (JP counterpart of U.S. Appl. No. 12/657,282 filed Jan. 15, 2010).

* cited by examiner 30 nanometer FWHM
center 450->x=0.1521, y=.0267
center 525 ->x=.1573, y=.7428
center 600 -> x=.6043, y=.3950

LIGHT EMISSIVE PRINTED ARTICLE PRINTED WITH QUANTUM DOT INK

FIELD OF THE INVENTION

The present invention relates to light emissive printed articles.

BACKGROUND

In today's competitive global market manufacturers and retailers must compete for consumers attention in an increasingly competitive environment. One form of advertisement uses posters. However, posters may not make much of an impression on consumers accustomed to high definition flat screen TV and computer displays. In order to make posters more memorable posters that include electroluminescent lamps that are patterned to show lighted areas of a product have been introduced. For example there are posters that use electroluminescent lamps as the lighted display of depicted cellular telephones. Electroluminescent lamps use multilayer structures that requires specialized equipment and techniques to manufacture them and so can not readily be made by local printers for use in a local retail market. Moreover, given the broad spectrum of electroluminescent lamps, finely tuned colors which are important for advertising materials can not be obtained without the added complexity of overlaid filters, which in any case would reduce brightness.

Thus, there is a need for luminescent posters with a broad color range and a simplified structure that lends itself to rapid production.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
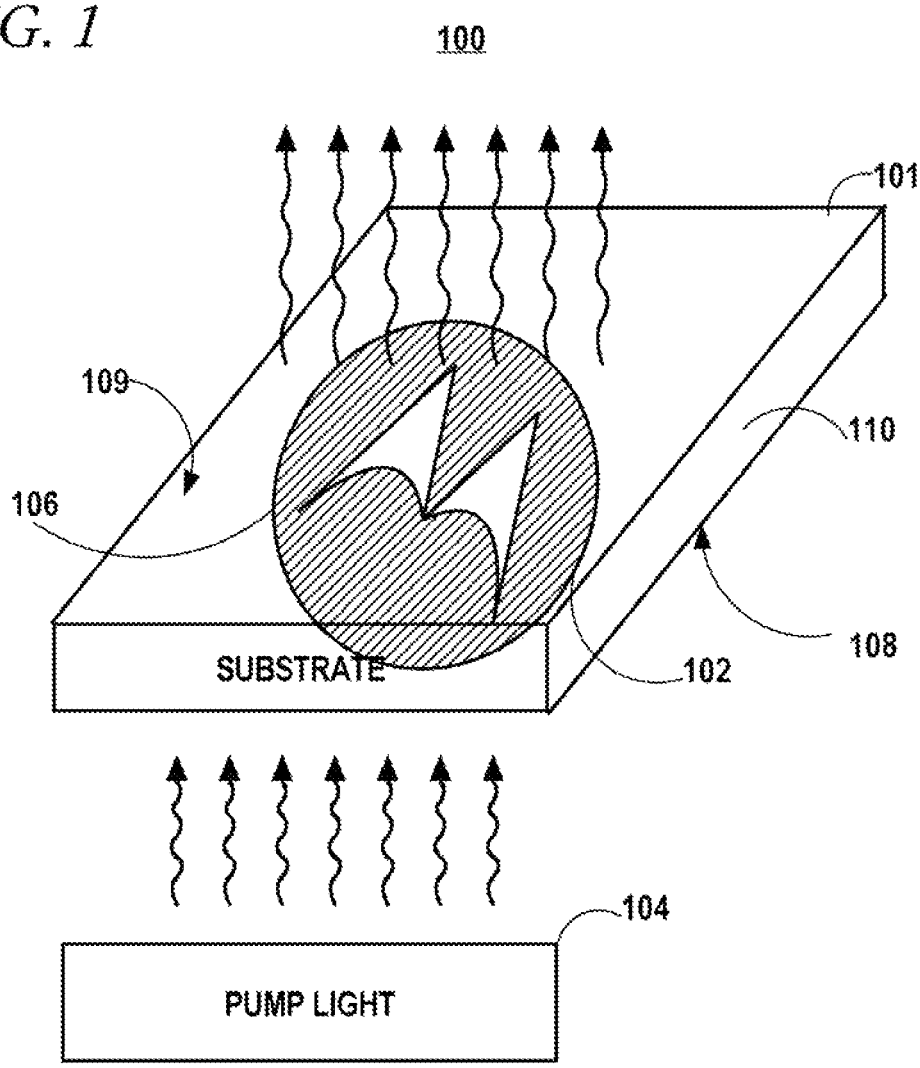
FIG. 1 is a schematic of a light emissive poster system including a light emissive poster printed with quantum dot ink and a pump light.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of and apparatus components related to quantum dot light emissive poster systems. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 is a schematic of a light emissive poster system 100 including a light emissive poster 101 printed with quantum dot ink 102 and a pump light 104. Printed graphics 106 include the quantum dot ink 102. The printed graphics 106 are printed on a backside 108 (a side that faces away from a viewer) of a substrate 110. The pump light 104 is arranged to illuminate the printed graphics 106. Alternatively, the printed graphics 106 are printed on a front side 109 of the substrate 109 and the pump light is positioned facing the front side 109. The pump light 104 emits ultraviolet and/or visible light including photons that have photon energies greater than a band gap of quantum dots (202, FIG. 2) in the quantum dot ink 102. Accordingly illuminating the printed graphics 106 with the pump light 104 causes the quantum dot ink 102 to emit light. Other graphics (not shown) that are not printed with the quantum dot ink 102 can also be printed on the substrate 108, so that only a portion of the poster 101 will be light emissive. The substrate 110 can be made out of a material, e.g., transparent plastic, that absorbs light (e.g., ultraviolet light) emitted by the pump light. The substrate 110 can be made out of a flexible and conformable material so that the poster 101 can be displayed in a non-planar configuration. Using a separate pump light 104 and poster 101 facilitates local design and printing of the poster 101. The poster 101 can be used in a scrollable display, such as used for advertising.

Multiple colors of quantum dot ink 102, each of which is characterized by a different band gap mean and peak color can be used so that the light emissive poster 101 will include multi-color light emissive printing.

Figure 2:
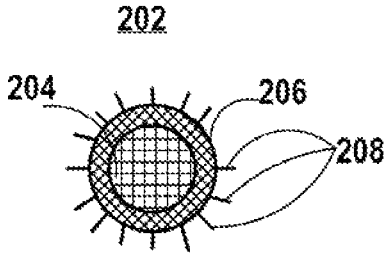
FIG. 2 is a schematic cross section of a functionalized core-shell quantum dot used in the ink of the light emissive poster shown in FIG. 1.

FIG. 2 is a schematic cross section of a functionalized core-shell quantum dot 202 used in the ink of the light emissive poster shown in FIG. 1. The quantum dot 202 includes a core 204 and a shell 206. The shell 206 is made of a material that has a higher band gap than a material of the core 204.

Using a higher band gap shell reduces a rate of non-radiative transitions thereby increase the efficiency and brightness of the quantum dot ink 102. The core 204 can, for example, be made of CdS, CdSe, CdTe, ZnS, ZnSe, ZnTe, GaAs, GaP, GaAs, GaSb, HgS, HgSe, HgTe, InAs, InP, InSb, AlAs, AlP, AlSb, whilst the shell 206 can, for example be made of ZnO, ZnS, ZnSe, ZnTe, CdO, CdS, CdSe, CdTe, MgS, MgSe, GaAs, GaN, GaP, GaAs, GaSb, HgO, HgS, HgSe, HgTe, InAs, InN, InP, InSb, AlAs, AlN, AlP, AlSb. Alternative quantum dot materials that may be used include but are not limited to tertiary microcrystals such as InGaP, which emits in the yellow to red wavelengths (depending on the size) and ZnSeTe, ZnCdS, ZnCdSe, and CdSeS which emits from blue to green wavelengths, (depending upon the size). Additional alternative materials that may be used in quantum dots include Zinc chalcogenides, such as ZnSe, doped with transition metal ions such as Mn or Cu. The quantum dot 202 is capped (functionalized) with organic molecules 208. In as much as quantum dots are prepared in colloidal systems a variety of molecules can be attached to them via metal coordinating functional groups, including thiols, amines, nitrites, phosphines, phosphine oxides, phosphonic acids, carboxylic acids or others ligands. With appropriate molecules bonded to the surface, the quantum dots could be readily included in different ink systems, without degrading their quantum electronic properties (e.g., emission efficiency). The organic molecules 208 render the quantum dot miscible with an organic resin and solvent of the quantum dot ink 102. The quantum dot ink 102 can be heat dryable or include a UV curable photochemical resin, for example.

Figure 3:
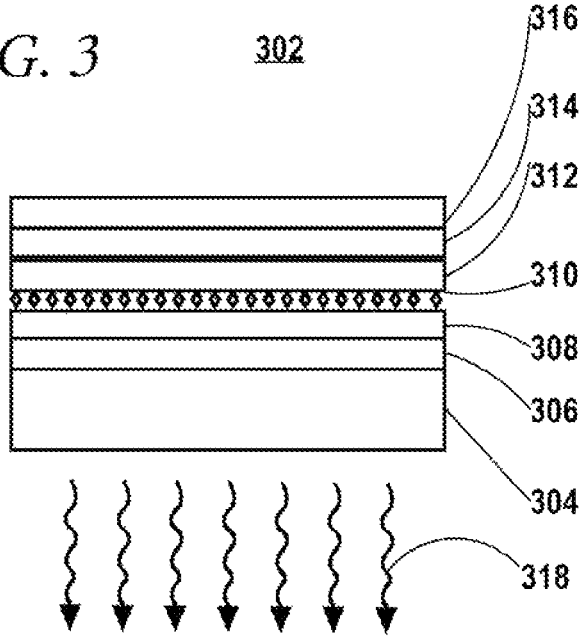
FIG. 3 is a schematic sectional elevation view of a quantum dot light emitting device that is used as the pump light shown in FIG. 1 according to an embodiment of the invention.

FIG. 3 is a schematic sectional elevation view of a quantum dot light emitting device 302 that is used as the pump light 104 shown in FIG. 1 according to an embodiment of the invention. The quantum dot light emitting device 302 includes a multilayer structure including, in sequence, a substrate (e.g., glass) 304, a transparent conductor (e.g., ITO) 306, an organic or inorganic hole transport layer (e.g., N,N0-diphenyl-N,N0-bis (3-methylphenyl)-(1,10-biphenyl)-4,40-diamine (TPD)) 308, a quantum dot layer 310, an organic or inorganic electron transport layer (e.g., tris-(8-hydroxyquinoline)aluminum or 3-(4-Biphenylyl)-4-phenyl-5-tert-butylphenyl-1, 2, 4-triazole (TAZ)) 312, an electron source layer (e.g., Mg:Ag) 314 and an electrical contact (e.g. Ag) 316. The light emitting device 302 emits photons 318 Alternatively, light emitting diodes that do not include quantum dots can be used. For example a GaN UV diodes can be used.

Figure 4:
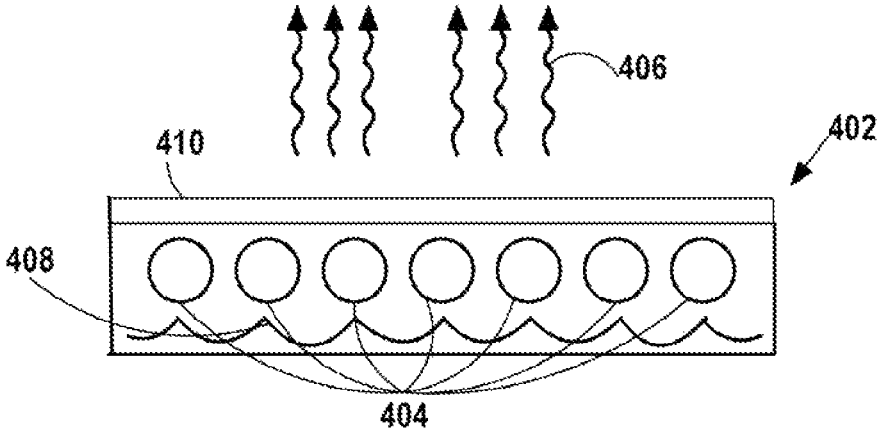
FIG. 4 is a schematic of a fluorescent lamp light box that is used as the pump light shown in FIG. 1 according to an alternative embodiment of the invention.

FIG. 4 is a schematic of a fluorescent lamp light box 402 that is used as the pump light 104 shown in FIG. 1 according to an alternative embodiment of the invention. The light box 402 includes a number of fluorescent light bulbs 404, such as those used in tanning beds or black lights, that emit UV light 406. A back reflector 408 is used to collect and direct the UV light 406 emitted by the bulbs 404. The UV light 406 passes out of the light box 402 through a protective window 410 that is made out of a UV transmissive material such as borosilicate glass or UV transmissive plastic such as a UV transmissive acrylic polymer such as Acrylite® H12-503 manufactured by Cyro Industries of Rockaway, N.J. According to an alternative embodiment of the invention a compact pump lamp such as a medium pressure arc lamp is used to illuminate the light emissive poster 101.

Figure 5:
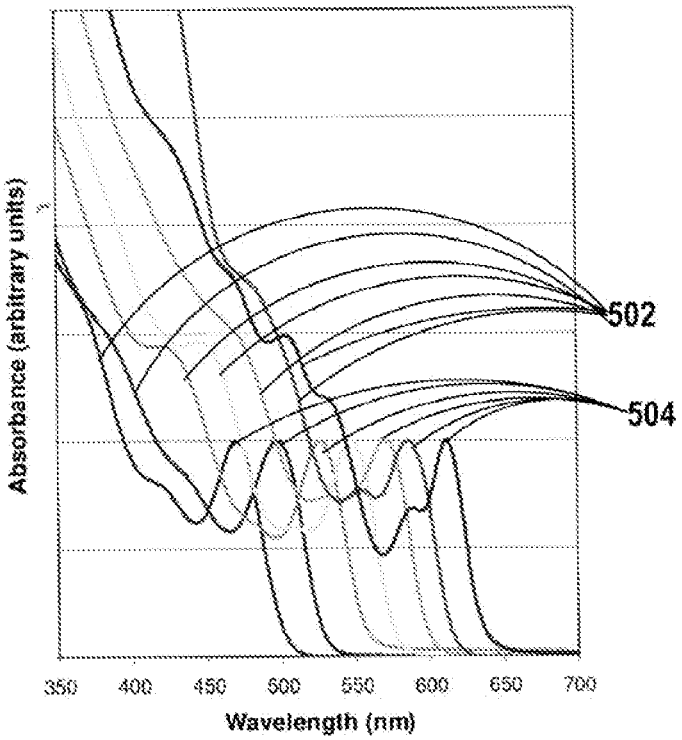
FIG. 5 is a graph including plots of quantum dot absorbance versus wavelength for several sizes of quantum dots.
Figure 6:
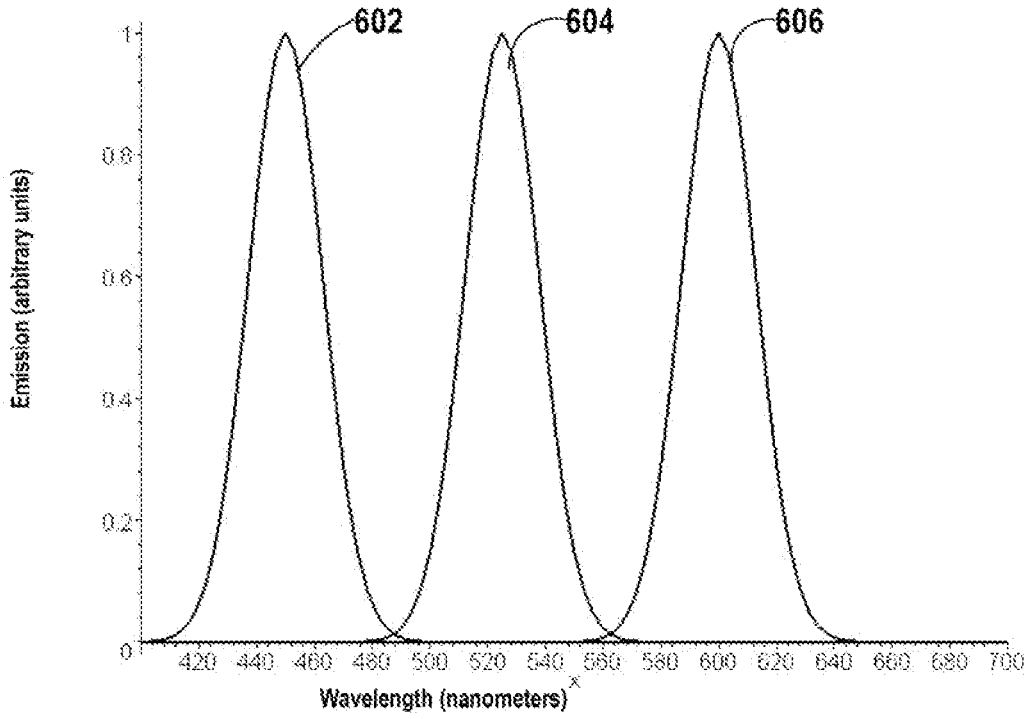
Prior Art FIG. 6
FIG. 6 is a graph including three lines of spectral emission for three size distributions of quantum dots.

FIG. 5 is a graph including plots 502 quantum dot absorbance versus wavelength for several sizes of quantum dots 202 that emit visible light. The plots 502 are for different sizes of quantum dots 202. Each plot 502 includes a local peak 504 that corresponds to its peak emission wavelength. As shown in FIG. 5 all of the quantum dots 202 represented in the plots 502 are able to effectively absorb pump light in the UVA range FIG. 6 is a graph including three lines 602, 604, 606 of spectral emission for three size distributions of quantum dots. The lines 602, 604, 606 exhibit Gaussian line shapes that have a FWHM of 30 nm. The spectral FWHM is a function of the size distribution FWHM. A first blue line 602, is centered at 450 nm, a second green line 604 is centered at 525 nanometers and a third red line 606 is centered at 600 nanometers.

Figure 7:
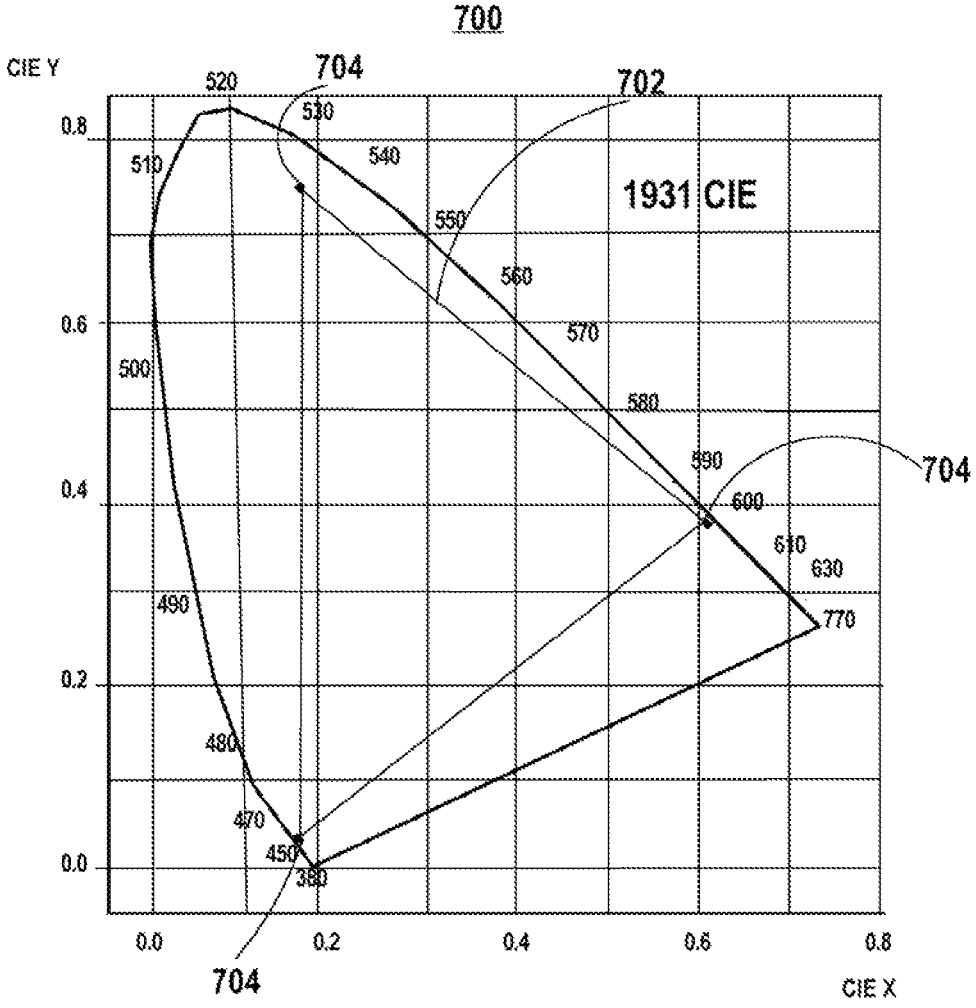
FIG. 7 is a 1931 CIE chart showing a color range obtainable by mixing quantum dots of the three distributions have the spectral emissions shown in FIG. 6.

FIG. 7 is a 1931 CIE chart 700 showing a color range 702 obtainable by mixing quantum dots of the three distributions have the spectral emissions shown in FIG. 6. One skilled in the art will appreciate that the use of quantum dots allows for fine control of the obtainable color space by controlling the center and FWHM of quantum dot size distributions used in the quantum dot ink 102. Although as shown in FIG. 7 only three color space points 704 are used to delineate the obtained color range 702, one skilled in the art will appreciate that an expanded color range can be obtained by using more than three quantum dot inks, with each ink having a different mean quantum dot size. A variety of printing techniques, such as for example Flexo, Gravure, Screen, inkjet can be used. The Halftone method, for example, allows the full color range 702 to be realized in actual printing.

Figure 8:
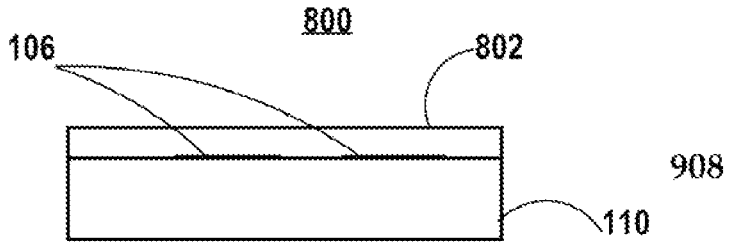
FIG. 8 a schematic cross section of a light emissive poster including an ink including quantum dots and a UV transparent overcoating.

FIG. 8 a schematic cross section of a light emissive poster 800 according to an alternative embodiment. The light emissive poster 800 includes a UV transparent coating 802 covering the printed graphics 106, so that the printed graphics 106 are disposed between the substrate 110 and the UV transparent coating 802. The UV transparent coating can for example be a UV transmissive acrylic polymer such as Acrylite® H12-503 manufactured by Cyro Industries of Rockaway, N.J. The photons 318 and UV light 406 can activate the printed graphics 106 through the UV transparent coating 802. The coating 802 serves to seal and protect the printed graphics 106.

For some applications, the poster 101 can be affixed to another object, such as for example, a carton or a container. Elongated quantum dot rods, which emit polarized light may be used. Elongated quantum dot rods are disclosed by Liangshi Li, J. Hu, W. Yang, and A. Paul Alivisatos in Nano Letters, 2001, Vol. 1 No. 7 pp 349-351.

Figure 9:
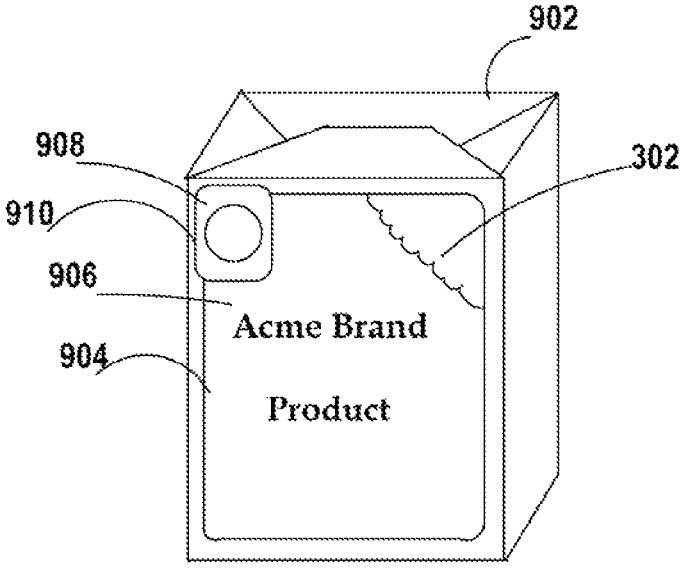
FIG. 9 shows a product package with a light emissive label that is printed with ink that includes quantum dots.

FIG. 9 shows a product package 902 with a light emissive label 904 with printing 906 with quantum dot ink. The label overlies the pump light source 302 which is supported on the package 902. A battery 908 in a battery case 910 is electrically coupled to and supplies electrical power to the pump light source In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. A light emissive printed article system comprising:

a light emissive printed article comprising:

a substrate; and a pattern prepared from an ink comprising quantum dots and a UV curable photochemical resin printed on a side of said substrate that faces away from a viewer, wherein said quantum dots are characterized by a plurality of energy band gaps corresponding to visible light wavelengths and are functionalized with organic molecules that are miscible with said UV curable photochemical resin; and a source of light comprising a pump light arranged so as to illuminate said pattern of ink from the side of the pattern that faces away from the viewer, wherein said source light emits light with photon energies greater than said energy band gaps.

2. The light emissive printed article system according to claim 1 wherein:

said quantum dots comprise:

a core; and a shell.

3. The light emissive printed article system according to claim 1 wherein:

said pump light comprises a semiconductor device.

4. The light emissive printed article system according to claim 3 wherein:

said semiconductor device comprise a light emitting diode.

5. The light emissive printed article system according to claim 1 wherein:

said pump light comprises quantum dots.

6. The light emissive printed article system according to claim 5 wherein:

said quantum dots of said pump light are disposed between an organic hole transport layer and an organic electron transport layer.

7. The light emissive printed article system according to claim 1 wherein:

said pump light comprises a fluorescent lamp.

8. The light emissive printed article system according to claim 1 comprising:

a viewed surface that faces a viewer of said printed article;

wherein said source of light emits UV light;

wherein said substrate is transmissive of visible light having said visible light wavelengths and said substrate blocks said UV light.

9. A product package comprising:

a pump light supported on the package;

a label including a pattern printed with ink comprising quantum dots and a UV curable photochemical resin on a side of the label that faces away from a viewer of the product package, the label overlying the pump light, the pump light being arranged so as to illuminate said pattern of ink from the side of the pattern that faces away from the viewer, wherein the quantum dots are functionalized with organic molecules that are miscible with said UV curable photochemical resin; and a battery supported coupled to said pump light.

10. The product package according to claim 9 wherein:

said quantum dots comprise:

a core; and a shell.

11. The product package according to claim 9 wherein said quantum dots comprise one or more materials selected from the group consisting of:

CdS, CdSe, CdTe, ZnS, ZnSe, ZnTe, GaAs, GaP, GaAs, GaSb, HgS, HgSe, HgTe, InAs, InP, InSb, AlAs, AlP, AISb, ZnO, ZnS, ZnSe, ZnTe, CdO, CdS, CdSe, CdTe, MgS, MgSe, GaAs, GaN, GaP, GaAs, GaSb, HgO, HgS, HgSe, HgTe, InAs, InN, InP, InSb, AlAs, AIN, AlP, AISb, ZnSeTe, ZnCdS, ZnCdSe, CdSeS, ZnSe doped with Mn and ZnSe doped with Mn and ZnSe doped with Cu. Cu.

12. The product package according to claim 9 further including a UV transparent coating covering the pattern, wherein the coating seals and protects the printed quantum dots.

13. A light emissive poster system comprising:

a light emissive printed article comprising a light emissive poster printed with a pattern of prepared from an ink including quantum dots quantum dots and a UV curable photochemical resin on a side of the poster that faces away from a viewer of the light emissive poster, wherein the quantum dots are functionalized with organic molecules that are miscible with said UV curable photochemical resin; and a pump light arranged so as to illuminate said pattern of ink from the side of the pattern that faces away from the viewer, the pump light comprising a light box including a number of fluorescent light bulbs and a back reflector to collect and direct the light emitted by the bulbs.

14. The light emissive poster system according to claim 13 wherein the fluorescent light bulbs emit UV light.

15. The light emissive poster system according to claim 13 further including a UV transparent coating covering the pattern, wherein the coating seals and protects the printed quantum dots.

* * * * *